US005378175A

United States Patent [19]

Regnier

[11] Patent Number: 5,378,175

[45] Date of Patent: Jan. 3, 1995

[54] ELECTRICAL CONNECTOR FOR MOUNTING ON A PRINTED CIRCUIT BOARD

[75] Inventor: Kent E. Regnier, Lombard, Ill.

[73] Assignee: Molex Incorporated, Lisle, Ill.

[21] Appl. No.: 173,584

[22] Filed: Dec. 22, 1993

[51] Int. Cl.[6] ..... H01R 13/41

[52] U.S. Cl. ..... 439/733; 439/869

[58] Field of Search ..... 439/733, 869

[56] References Cited

U.S. PATENT DOCUMENTS

| | | | |
|---|---|---|---|
| 3,621,444 | 11/1971 | Stein | 439/733 |
| 4,176,900 | 12/1979 | Hines et al. | 439/260 |
| 5,082,459 | 1/1992 | Billman et al. | 439/637 |
| 5,137,454 | 8/1992 | Baechtle | 439/62 |

FOREIGN PATENT DOCUMENTS

| | | | |
|---|---|---|---|
| 1810513 | 6/1970 | Germany | 439/733 |

*Primary Examiner*—Gary F. Paumen
*Attorney, Agent, or Firm*—Charles S. Cohen

[57] ABSTRACT

An electrical connector is adapted for mounting on a printed circuit board. The connector includes a dielectric housing having a plurality of terminal-receiving passages. A plurality of standoffs project from the housing toward the printed circuit board to space the housing from the board. The housing is unitarily molded of plastic material. A plurality of terminals are received in the passages. Each terminal includes a contact beam section in the housing, a tail section projecting from the housing and a retention section therebetween. A plurality of retention bosses are molded integrally with the housing in alignment with the passages and project from the housing toward the printed circuit board whereby the passages extend through the retention bosses. The terminals are stamped and formed of sheet metal material with at least portions of the retention sections of the terminals being located in the passages within the retention bosses. In an alternate embodiment of the invention, the standoffs are eliminated, and the retention bosses perform a dual function of retaining the terminals and providing standoffs for the connector.

13 Claims, 4 Drawing Sheets

ELECTRICAL CONNECTOR FOR MOUNTING ON A PRINTED CIRCUIT BOARD

FIELD OF THE INVENTION

This invention generally relates to the art of electrical connectors and, particularly, to a low profile electrical connector adapted for mounting on a printed circuit board.

BACKGROUND OF THE INVENTION

A typical electrical connector which is adapted for mounting on a printed circuit board includes a dielectric housing having a plurality of terminal-receiving passages, with a plurality of terminals received in the passages. Each terminal includes a contact beam section in the housing, a solder tail section projecting from the housing and a retention section between the contact beam section and the solder tail section.

Such circuit board mounted electrical connectors often include "standoffs" projecting from the housing toward the printed circuit board to space the housing from the board. This spacing facilitates cleaning the housing, such as with wash-through processes, which remove flux and other contaminants after the solder tails of the terminals have been soldered to circuit traces on the printed circuit board.

With the ever-increasing miniaturization of electronic circuitry, there is a continuing demand for low-profile electrical connectors, i.e., connectors which extend a minimal distance away from the circuit board yet still require relatively low insertion forces and have a high density of terminals. This demand causes problems, because there always are dimensional limitations in designing any particular connector. For instance, the contact beam sections of the terminals rarely can be changed because the connector is designed for particular performance characteristics. The retention sections of the terminals must be sufficiently large to properly retain the terminals within the connector housing. And, the standoffs must provide adequate space between the housing and the circuit board to allow for proper cleaning. These restrictions create quite a dilemma. Nevertheless, the present invention is directed to a unique terminal retention system for solving these problems and reducing the "height" of an electrical connector, even within the constraints defined above.

SUMMARY OF THE INVENTION

An object, therefore, of the invention is to provide a new and improved electrical connector for mounting on a printed circuit board and, particularly, to a connector which reduces the height profile of the connector.

In the exemplary embodiment of the invention, the connector includes a dielectric housing having a plurality of terminal-receiving passages and a plurality of standoffs projecting from the housing toward the printed circuit board to space the housing from the board. The housing is shown in the preferred embodiment as being unitarily molded of plastic material. A plurality of terminals are received in the passages. Each terminal includes a contact beam section in the housing, a tail section projecting from the housing and a retention section therebetween.

The invention contemplates the provision of a plurality of retention bosses molded integrally with the housing in alignment with the passages, the bosses projecting into the space between the housing and the circuit board, with the passages extending through the bosses. The terminals may be stamped and formed of sheet metal material, and at least portions of the retention sections of the terminals are located in the passages within the bosses. Therefore, the bosses cooperate with the retention sections to retain the terminals in the housing, and the overall height profile of the connector is reduced by the distance that the retention bosses project from the housing.

In the preferred embodiment of the invention, the retention sections of the terminals are wider, in a direction transversely of the passages, than the contact beam sections and the tail sections. The tail sections comprise straight solder tails for insertion into holes in the printed circuit board. The contact beam sections are formed into reversely bent configurations to define spring contact arms.

In an alternate embodiment of the invention, the retention bosses actually are the standoffs for the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
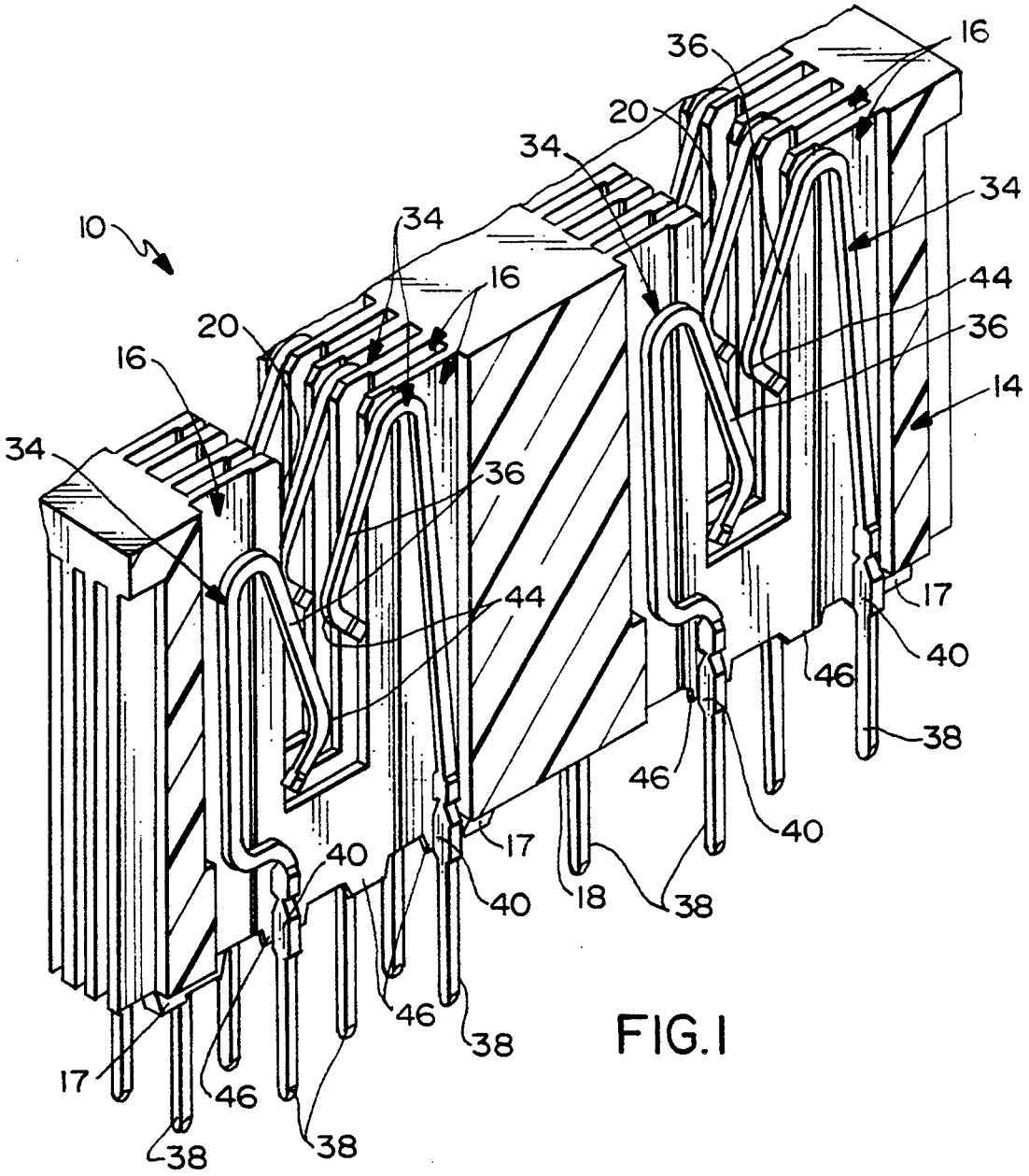
FIG. 1 is a fragmented perspective view of a section through an electrical connector embodying the concepts of the invention.
Figure 2:
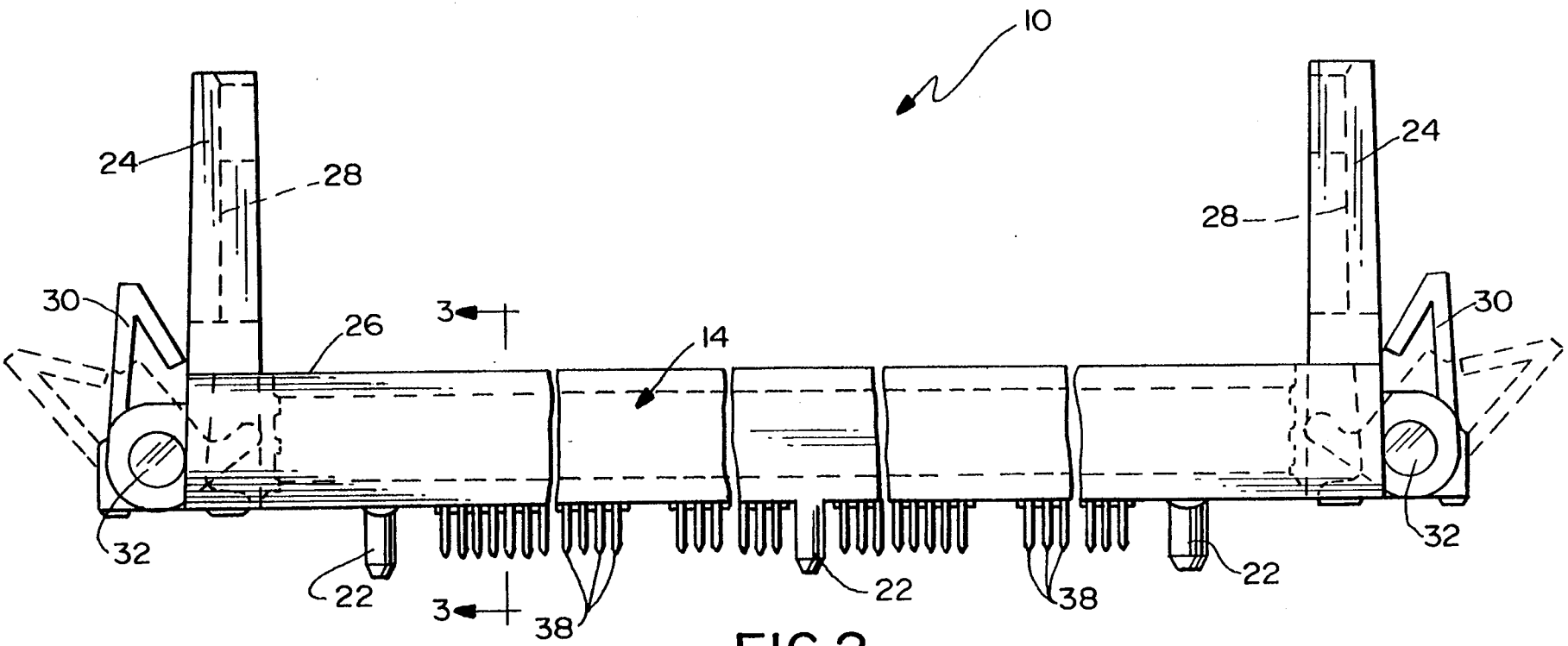
FIG. 2 is a side elevational view of the connector.
Figure 3:
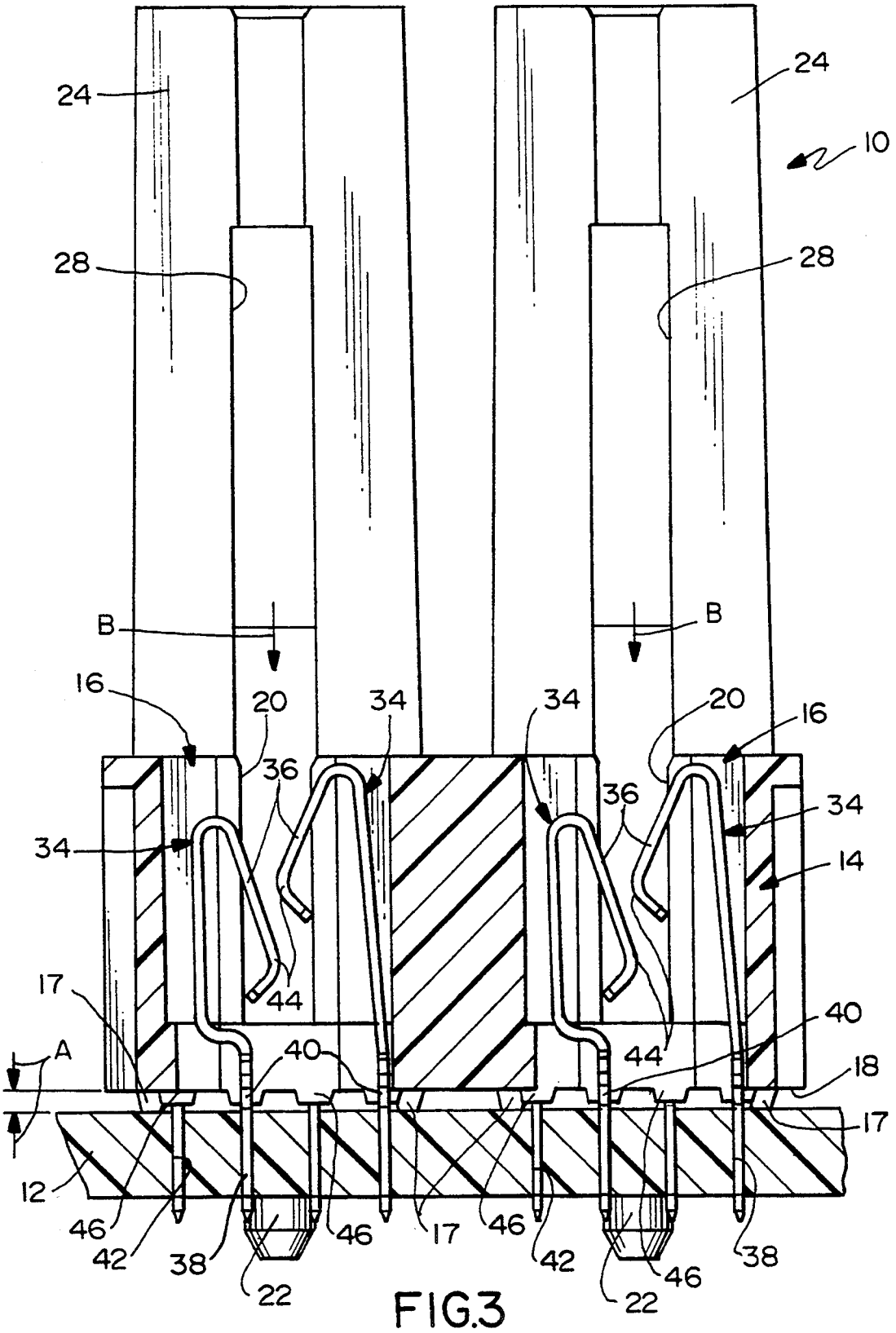
FIG. 3 is section taken generally along line 3—3 FIG. 2.

Referring to the drawings in greater detail, and first to the embodiment of the invention shown in FIGS. 1–3, the invention is incorporated in an electrical connector, generally designated 10, for mounting on a printed circuit board 12 (FIG. 3). The connector includes a dielectric housing, generally designated 14, having a plurality of terminal-receiving passages, generally designated 16. A plurality of standoffs 17 project from a bottom board-mounting face 18 of the housing toward the printed circuit board to space the housing from the board. The housing is unitarily molded of plastic material, and standoffs 17 are molded integrally therewith. The standoffs provide a spacing, as indicated by arrows "A" in FIG. 3, to allow for cleaning processes, such as wash-through processes, to remove flux and other contaminants after the connector is soldered to printed circuit board 12.

Referring particularly to FIG. 3, housing 14 defines a pair of board-receiving slots 20 for insertion thereinto of a pair of printed circuit boards in the direction of arrows "B." In practice, printed circuit board 12 is considered the "mother" board and the printed circuit boards (not shown) which are inserted into slots 20 are considered "daughter" boards. FIG. 3 also shows that a plurality of mounting posts 22 project from bottom face 18 of the housing for insertion into appropriate mounting holes in circuit board 12. Like standoffs 17, mounting posts 22 are molded integrally with the housing.

Referring specifically to FIG. 2, it can be seen that housing 14, and thereby connector 10, is considerably elongated. A pair of end posts 24 project upwardly from a top board-receiving face 26 of the housing, and the posts have inwardly directed grooves 28 (also see FIG. 3) for receiving the side edges of the daughter boards when they are inserted into slots 20 in the direction of arrows "B" (FIG. 3). FIG. 2 also shows a pair of ejecting levers 30 pivotally mounted on housing 14, outside posts 24, on pivot means 32. As is known in the art, the ejecting levers facilitate ejecting the daughter boards from board-receiving slots 20 in housing 14.

As best seen in FIGS. 1 and 2, a plurality of terminals, generally designated 34, are received in terminal-receiving passages 16. Each terminal is a stamped and formed sheet metal component and includes a semi-bellows contact beam section 36 located in housing 14, a tail section 38 projecting from bottom face 18 of the housing, and a retention section 40 between the contact beam and tail sections.

The retention sections of the terminals are wider, in a direction transversely of passages 16, than the contact beam sections and the tail sections. The tail sections are provided as straight solder tails for insertion into holes 42 (FIG. 3) in circuit board 12 for soldering to circuit traces on the board and/or in the holes. The contact beam sections of the terminals are formed into reversely bent configurations to define spring contact arms having contact areas 44 for engaging circuit pads on opposite sides of the daughter boards inserted into board-receiving slots 20.

The invention contemplates a unique system for reducing the height profile of a given electrical connector of the type described above. In particular, a plurality of retention bosses 46 are molded integrally with housing 14 in alignment with terminal-receiving passages 16 whereby the passages extend through the retention bosses. Actually, the retention bosses are "split" portions of housing 14 on opposite sides of terminal-receiving passages 16 and surrounding the retention sections 40 of terminals 34. In other words, in order to minimize the vertical amount of housing above board mounting face 18 utilized to retain the terminals (which maximizes the vertical height usable for the contact beam), retention bosses 46 extend downward below mounting face 18 in order to provide additional material to retain the terminal within the housing. At least portions of the retention sections of the terminals are located in the passages within the retention bosses. In essence, this enables the retention sections of the terminals to project downwardly below bottom face 18 of the housing and still be surrounded by sufficient plastic material of the housing to effect a retention function for the terminals between the retention sections and the housing. As a result, a longer portion of the terminals 34 may be used for the contact beam section 36 which could result in lower stresses therein.

As seen in FIG. 3, retention bosses 46 do not project below bottom face 18 of the housing as far as standoffs 17. Therefore, the standoffs actually engage printed circuit board 12. By making retention bosses 46 slightly shorter than standoffs 16, the fabrication of connector 10 does not have to be absolutely precise in the loading of terminals 34 into passages 16 of the housing. In other words, retention sections 40 have been shown intentionally in FIGS. 1 and 3 as projecting very slightly below the retention bosses. In actual practice, during fabrication, the retention sections of the terminals may so project below the retention bosses, or the retention sections may be flush with the bosses, or the retention sections may be located completely within the bosses. By having the bosses slightly shorter than the standoffs, these variations can be accommodated.

Figure 4:
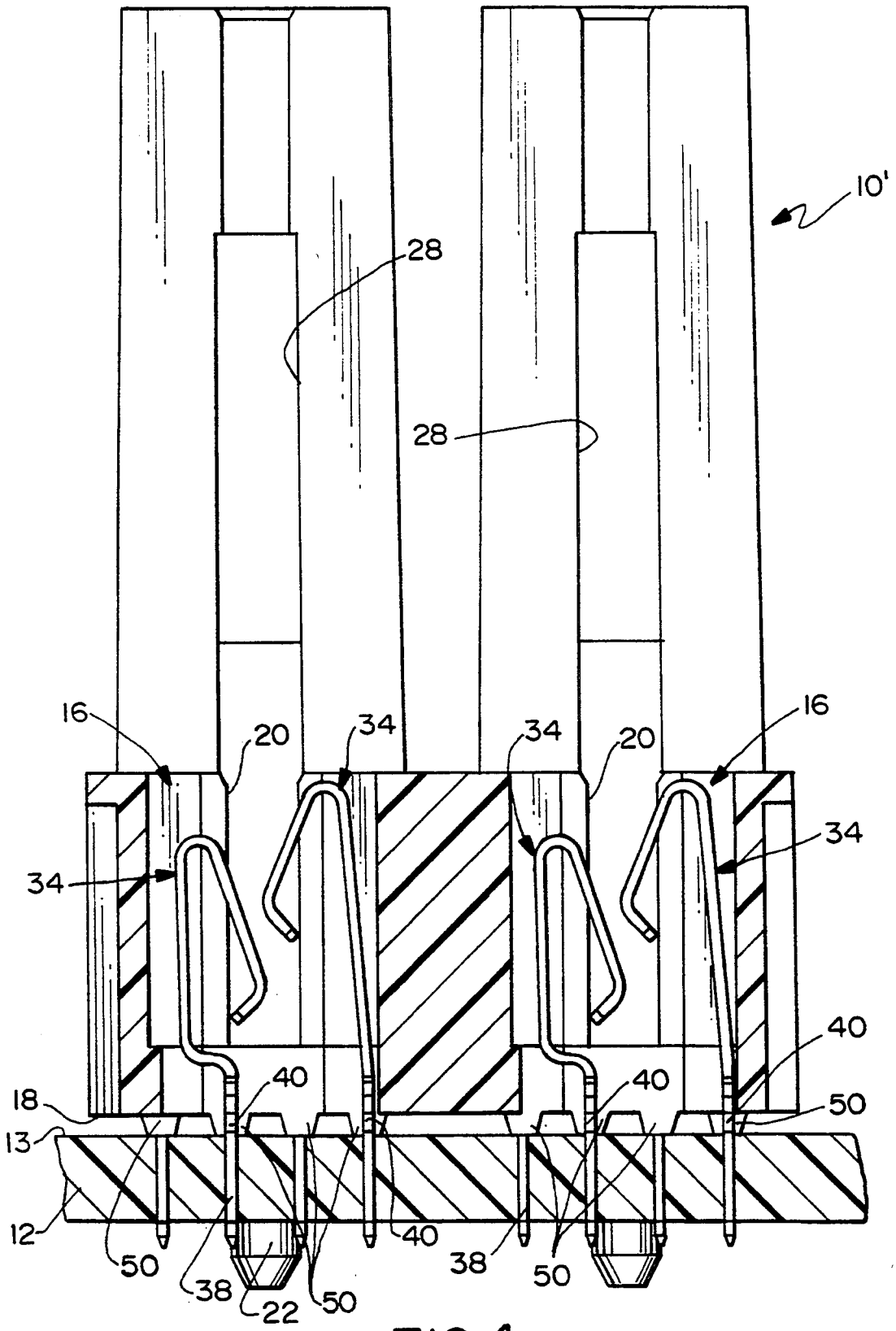
FIG. 4 is a view similar to that of FIG. 3, but of an alternate embodiment of the invention.

On the other hand, there may be instances where the precision of inserting the terminals is no problem and/or it may be desirable to completely eliminate any standoffs (such as standoffs 17) from the connector. In such instances, FIG. 4 show an alternate embodiment of the invention wherein retention bosses 50 are shown substantially identical (except slightly longer) to retention bosses 46 shown in the embodiment of FIGS. 1–3. However, it can be seen that the connector 10' in FIG. 4 does not have any separate standoffs. Consequently, retention bosses 50 in connector 10' perform the dual function of providing a standoff means for the connector as well as a means within which the retention sections of the terminals are retained within the spacing between the bottom face of the housing and the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an edge card connector for mounting on a printed circuit board, the connector including a dielectric housing having a board mounting face adapted to be positioned adjacent said printed circuit board, a card receiving face having a card slot extending along a longitudinal axis of said housing and a plurality of terminal-receiving passages adjacent said slot, the housing being unitarily molded of plastic material, a plurality of standoffs projecting from the board mounting face of the housing a first predetermined distance away from said board mounting face to space the housing from the board upon placement thereon, and a plurality of terminals received in said passages, each terminal including a contact beam section in the housing, a tail section projecting from the housing and a retention section therebetween for engaging a portion of said housing to retain said terminal therein, wherein the improvement comprises:

a plurality of retention bosses molded integrally with said housing in alignment with the passages and with the passages extending through the bosses, the retention bosses projecting from the board mounting face of the housing a second predetermined distance away from said board mounting face, said second predetermined distance being less than said first predetermined distance, and said terminals being stamped and formed of sheet metal material with at least portions of the retention sections of the terminals being located in the passages within the bosses.

2. In an edge card connector as set forth in claim 1, wherein the retention sections of said terminals are wider, in a direction transversely of the passages, than the contact beam sections and the tail sections.

3. In an edge card connector as set forth in claim 2, wherein the contact beam sections of said terminals are formed into a semi-bellows configuration to define spring contact arms.

4. In an edge card connector as set forth in claim 1, wherein said standoffs are integrally molded as part of said housing.

5. In an edge card connector as set forth in claim 1, wherein said one end of said retention section is interconnected to said contact beam section and the other end of said retention section is interconnected to said tail section.

6. In an edge card connector for mounting on a printed circuit board, the connector including a one-piece dielectric housing having a board mounting face adapted to be positioned adjacent a planar surface of said printed circuit board, a card receiving face having a card slot extending along a longitudinal axis of said housing and a plurality of terminal-receiving passages adjacent said slot, the housing being unitarily molded of plastic material, a plurality of standoffs projecting from the board mounting face of the housing adapted to contact the planar surface of the circuit board to space the housing from the board upon placement thereon, and a plurality of terminals received in said passages, each terminal including a contact beam section in the housing, a tail section projecting from the housing and a retention section therebetween for engaging a portion of said housing to retain said terminal therein, wherein the improvement comprises:

said standoffs being molded integrally with said housing in alignment with the passages and with the passages extending through the standoffs, and said terminals being stamped and formed of sheet metal material with at least portions of the retention sections of the terminals being located in the passages within the standoffs.

7. In an edge card connector as set forth in claim 6, wherein the retention sections of said terminals are wider, in a direction transversely of the passages, than the contact beam sections and the tail sections.

8. In an edge card connector as set forth in claim 7, wherein the contact beam sections of said terminals are formed into reversely bent configurations to define spring contact arms.

9. In an edge card connector as set forth in claim 6, wherein said standoffs are integrally molded as part of said housing.

10. In an edge card connector as set forth in claim 6, wherein said one end of said retention section is interconnected to said contact beam section and the other end of said retention section is interconnected to said tail section.

11. In an electrical connector for mounting on a printed circuit board, the connector including an dielectric housing having a board mounting face adapted to be positioned adjacent a planer surface of said printed circuit board, a mating face adapted to receive a mating electronic component and a plurality of terminal-receiving passages adjacent mating face, the housing being unitarily molded of plastic material, and a plurality of terminals received in said passages, each terminal including a contact section in the housing, a tail section projecting from the housing and a retention section therebetween for engaging a portion of said housing to retain said terminal therein, wherein the improvement comprises:

a plurality of retention bosses molded integrally with said housing in alignment with the passages and projecting downward from the board mounting face of the housing a predetermined distance away from said board mounting face, said passages extending through the bosses, and said terminals being stamped and formed of sheet metal material with at least portions of the retention sections of the terminals being located in the passages within the bosses, further comprising a plurality of standoffs projecting from the board mounting face of the housing a predetermined distance away from said board mounting face to space the housing from the board upon placement thereon, wherein said standoffs project a first predetermined distance from the board mounting face and the retention bosses project from the board mounting face of the housing a second predetermined distance away from said board mounting face, said second predetermined distance being less than said first predetermined distance.

12. In an electrical connector as set forth in claim 11 wherein said standoffs are integrally molded as part of said housing.

13. In an electrical connector for mounting on a printed circuit board, the connector including a one-piece housing having a board mounting face adapted to be positioned adjacent a planar surface of said printed circuit board, a mating face adapted to receive a mating electronic component and a plurality of terminal-receiving passages adjacent mating face, the housing being unitarily molded of plastic material, and a plurality of terminals received in said passages, each terminal including a contact section in the housing, a tail section projecting from the housing and a retention section therebetween for engaging a portion of said housing to retain said terminal therein, wherein the improvement comprises:

a plurality of retention bosses molded integrally with said housing in alignment with the passages and projecting downward from the board mounting face of the housing a predetermined distance away from said board mounting face, said passages extending through the bosses, said retention bosses being adapted to engage the planar surface of the printed circuit board to space the board mounting face from said printed circuit board, and said terminals being stamped and formed of sheet metal material with at least portions of the retention sections of the terminals being located in the passages within the bosses.

* * * * *